US006173865B1

(12) United States Patent
Loynes

(10) Patent No.: US 6,173,865 B1
(45) Date of Patent: Jan. 16, 2001

(54) TELESCOPING FUEL DISPENSER

(75) Inventor: Wayne Loynes, Fort Wayne, IN (US)

(73) Assignee: Tokheim Corporation, Fort Wayne, IN (US)

( * ) Notice: Under 35 U.S.C. 154(b), the term of this patent shall be extended for 0 days.

(21) Appl. No.: 09/417,504

(22) Filed: Oct. 13, 1999

(51) Int. Cl.[7] ..... B67D 5/04

(52) U.S. Cl. ..... 222/71; 222/74; 222/173; 312/257.1; 312/205

(58) Field of Search ..... 312/257.1, 205; 222/71, 74, 173

(56) References Cited

U.S. PATENT DOCUMENTS

| | | | | |
|---|---|---|---|---|
| D. 100,097 | | 6/1936 | Fox . | |
| D. 244,563 | * | 5/1977 | Taylor et al. | D15/9.2 |
| D. 262,115 | * | 12/1981 | Rowan et al. | D15/9.2 |
| D. 262,970 | | 2/1982 | Rowan et al. | D15/2 |
| D. 264,471 | * | 5/1982 | Rowan et al. | D15/9.2 |
| D. 272,630 | * | 2/1984 | Koppens | D15/9.2 |
| 3,199,727 | * | 8/1965 | Romanowski | 222/20 |
| 3,670,930 | | 6/1972 | Irie et al. . | |
| 3,883,042 | * | 5/1975 | Junker | 222/174 X |
| 4,138,042 | | 2/1979 | Okada . | |
| 4,253,607 | | 3/1981 | Gerard, Sr. . | |
| 4,573,502 | | 3/1986 | Hurley et al. . | |
| 4,576,312 | * | 3/1986 | Swick, Jr. | 222/173 X |
| 5,083,846 | * | 1/1992 | Day, Jr. et al. | 222/74 X |
| 5,163,586 | * | 11/1992 | Zinsmeyer | 222/71 X |
| 5,609,190 | | 3/1997 | Anderson et al. . | |
| 5,630,528 | * | 5/1997 | Nanaji | 222/71 X |
| 5,634,503 | | 6/1997 | Musil et al. . | |
| 5,651,478 | * | 7/1997 | Tatsuno | 222/71 X |
| 5,727,765 | | 3/1998 | Alvern . | |

FOREIGN PATENT DOCUMENTS

| | | |
|---|---|---|
| 214545 | 3/1938 | (JP) . |

* cited by examiner

*Primary Examiner*—Kenneth Bomberg
(74) *Attorney, Agent, or Firm*—Randall J. Knuth

(57) ABSTRACT

A fuel dispenser with telescoping frame having a upper column portion operatively affixed to a lower column portion for movement of the upper column portion relative to the lower column portion. In one embodiment, a valance is attached to the upper column portion. In this embodiment, the upper column portion and valance are adapted for movement toward and away from the lower column portion.

16 Claims, 2 Drawing Sheets

TELESCOPING FUEL DISPENSER

BACKGROUND OF THE INVENTION

1. Field of the Invention.

The present invention relates to a fuel dispenser and, in particular, a fuel dispenser with telescoping frame.

2. Description of the Related Art.

Many contemporary fuel dispensers contain a base unit with two upright column portions attached to the left and right side of the base unit and extending upward from the base. A raceway or valance portion is then attached to the top of the uprights, spanning the distance between the two upright column portions. Traditionally, the frame (the two uprights and valance portion) are assembled together for shipment as a single unit.

Many freight forwarders impose height restrictions on the size of the package a carrier will ship. For example, in Asia, the height limit is 14 inches shorter than that of the United States. With this height restriction in mind, fuel dispenser manufacturers will manufacture and design fuel dispensers which are shorter to accommodate the height restriction when shipping their fuel dispenser to foreign countries.

One problem in the art is that it is not possible to manufacture and ship a single fuel dispenser model for both domestic and foreign use. Due to some countries' shipping height restrictions, a different model with a lower height is manufactured for distribution in countries with such height restrictions. Having to manufacture, design, and inventory multiple models having different heights increases the cost of manufacturing fuel dispensers.

What is needed in the art is a fuel dispenser for domestic and foreign distribution which accommodates a shipping height limitation while permitting a maximum height installation.

SUMMARY OF THE INVENTION

The present invention is a fuel dispenser with telescoping frame. The telescoping frame contains a lower column portion attached to a base. An upper column portion is operatively affixed to the lower column portion for movement of the upper column portion relative to the lower column portion. Raising and lowering the upper column portion relative to the base permits a fuel dispenser to telescope from a low telescoping position to a high telescoping position.

During shipment, the fuel dispenser can be in its low telescoping or shipment configuration. In its shipment configuration, the upper column portion is in its lowest position. The upper column portion can be telescoped from the shipment confirmation to a high telescoping or an installed confirmation by raising the upper column portion relative to the lower column portion. Depending upon the height desired, the upper column portion may be raised or lowered as desired for ones particular installation.

The invention, in one form thereof, is a fuel dispenser with telescoping frame. The fuel dispenser contains a base and a lower column portion affixed to the base. An upper column portion is operatively affixed to the lower column portion for movement of said upper column portion relative to said lower column portion. In a further embodiment, the fuel dispenser contains a second upper column portion and a valance spanning between the upper column portions.

The invention, in another embodiment thereof, is a fuel dispenser with telescoping frame. The fuel dispenser contains a base and a pair of lower column portions. The pair of lower column portions are affixed to the base. The pair of upper column portions are operatively affixed to the pair of lower column portions for movement of the upper column portions relative to the lower column portions. A valance spans between the pair of upper column portions. The pair of upper column portions are adapted for movement toward and away from base 12. A hose is attached to one of one pair of upper column portions and the valance.

One advantage of the present invention is that a single model may be manufactured for both domestic and foreign distribution. The fuel dispenser of the present invention may be shipped in a shipment or lower telescoping configuration. When in its shipment configuration, the fuel dispenser has a dimension compliant with both domestic and foreign shipping restrictions. At the installation site, the fuel dispenser can be transformed from its shipping configuration to its installed configuration. Therefore, a single model may be manufactured for both domestic and foreign distribution.

Another advantage of the present invention is that a smaller dimensioned dispenser can be shipped. The decrease in dimension, and in particular, height of the present invention over the prior art, permits a smaller dimensioned dispenser to be shipped. As a result of the smaller shipping size, there the cost savings attributed to the decrease in size as compared with traditional full-height fuel dispensers.

Another advantage of the present invention is that a single person can transform the present invention from its shipment configuration to its installed configuration.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
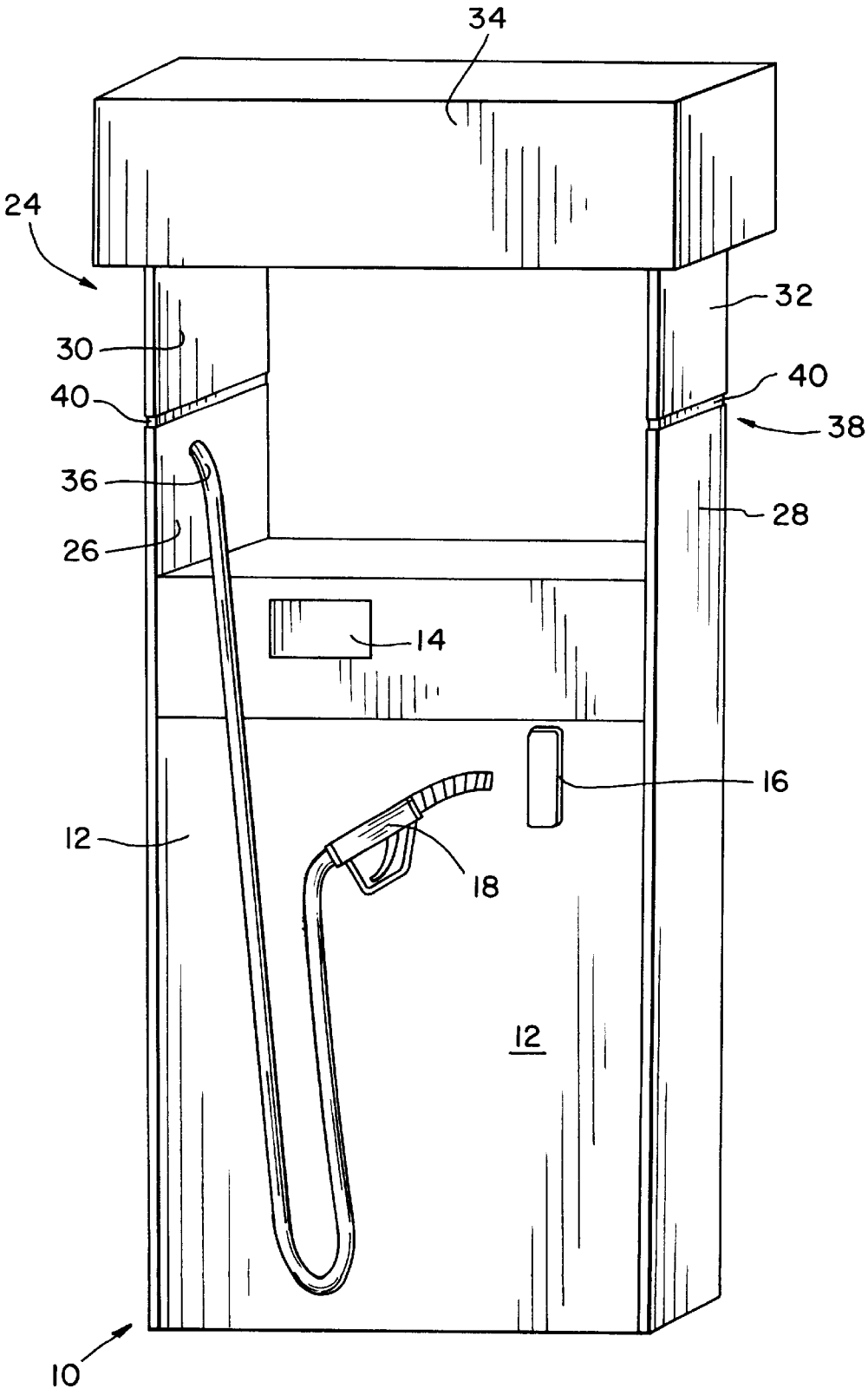
FIG. 1 is a front elevational view of one embodiment fuel dispenser according to the present invention.

Referring now to the drawings and in particular to FIG. 1, there is shown fuel dispenser 10 which encompasses the present invention. Fuel dispenser 10 contains a base 12. Base 12 encloses the hydraulics and electronics components of fuel dispenser 10. Such hydraulic components may include fuel supply conduit and fuel meters (not shown). The electronics enclosed by base 12 include display screen 14 for displaying the price and quantity of fuel dispensed from fuel dispenser 10. A boot 16 acts as a cradle for nozzle 18. When fuel dispenser 10 is not in use, boot 16 affixes nozzle 18 to base 12.

A frame 24 forms the left and right side of base 12. Frame 24 includes left and right lower column portions 26, 28, respectively. Frame 24 also includes left and right upper column portions 30, 32.

Left and right upper column portions 30, 32 are operatively affixed to the pair of lower column portions 26, 28, respectively, for movement of the pair of upper column portions 30, 32 toward and away from base 12. Alternatively, a single upper and single lower column could be utilized. In the alternative embodiment, a single column may move relative a single lower column.

A valance 34 spans the distance between left column portion 30 and right upper column portion 32. Valance 34 is rigidly attached to the pair of upper column portions 30, 32 such that left and right upper column portions 30, 32 and valance 34 act as a unit for moving in unison toward and away from base 12.

Hose 36 extends from left lower column portion 26. Alternatively, hose 36 may extend from left upper column portion 30 or valance 34. Hose 36 provides a conduit for fuel to be supplied from fuel dispenser 10. Fuel is dispensed from hose 36 through nozzle 18 and into ones vehicle during re-fueling.

During operational use of this invention, left and right upper column portions 30, 32 may be raised or lowered relative to base 12. During shipping, it is advantageous to have left and right upper column portions 30, 32 in their lowest height position or shipment configuration. When fuel dispenser 10 is in its shipment configuration, the height of fuel dispenser 10 is at its minimum. As a result, the shipping size dimension of fuel dispenser 10 is at its minimum. The advantage of shipping fuel dispenser 10 in its shipment configuration is that some couriers or shippers domestically or foreign have height restrictions on packages.

During installation of fuel dispenser 10, left and right upper column portions 30, 32 respectively, are raised from a shipment configuration to an installed configuration. Transformation of fuel dispenser 10 from its shipment to installed configuration entails raising the height of left and right upper column portions 30, 32 relative to base 12. Adjustment means 38 facilitates the raising and lowering of left and right upper column portions 30, 32 by movement of left and right upper column portions 30, 32 toward and away from base 12. The task of raising and lowering of left and right upper column portions 30, 32 can be done by a single person.

In one embodiment, the adjustment method consists of a spring loaded paw, mounted to the inner column, that engages the outer column by locking into slots punched into the sleet metal. To raise the upper portion the paw will be tapered so no tools are required, just an upward manual push top of the portion. To lower the paw, the paw will have to be disengaged manually by pushing on a tap on the paw, which in turn, will release the paw from engaging the outer column.

Left and right upper column portions 30, 32 are operatively affixed to left and right lower column portions 26, 28 for movement of the left and right upper column portions toward and away from the left and right lower column portions 26, 28. Upper and lower column portions meet at conjunction 40. Left and right upper column portions 30, 32 are adapted to engage with left and right lower column portions 26, 28 for permitting left and right upper column portions 30, 32 to be raised or lowered relative to left and right lower column portions 26, 28. The engagement of left and right upper column portions 30, 32 with left and right lower column portions 26, 28 may be any connection whereby allowing upper column portions 30, 32 to be raised or lowered relative to base 12.

Figure 2:
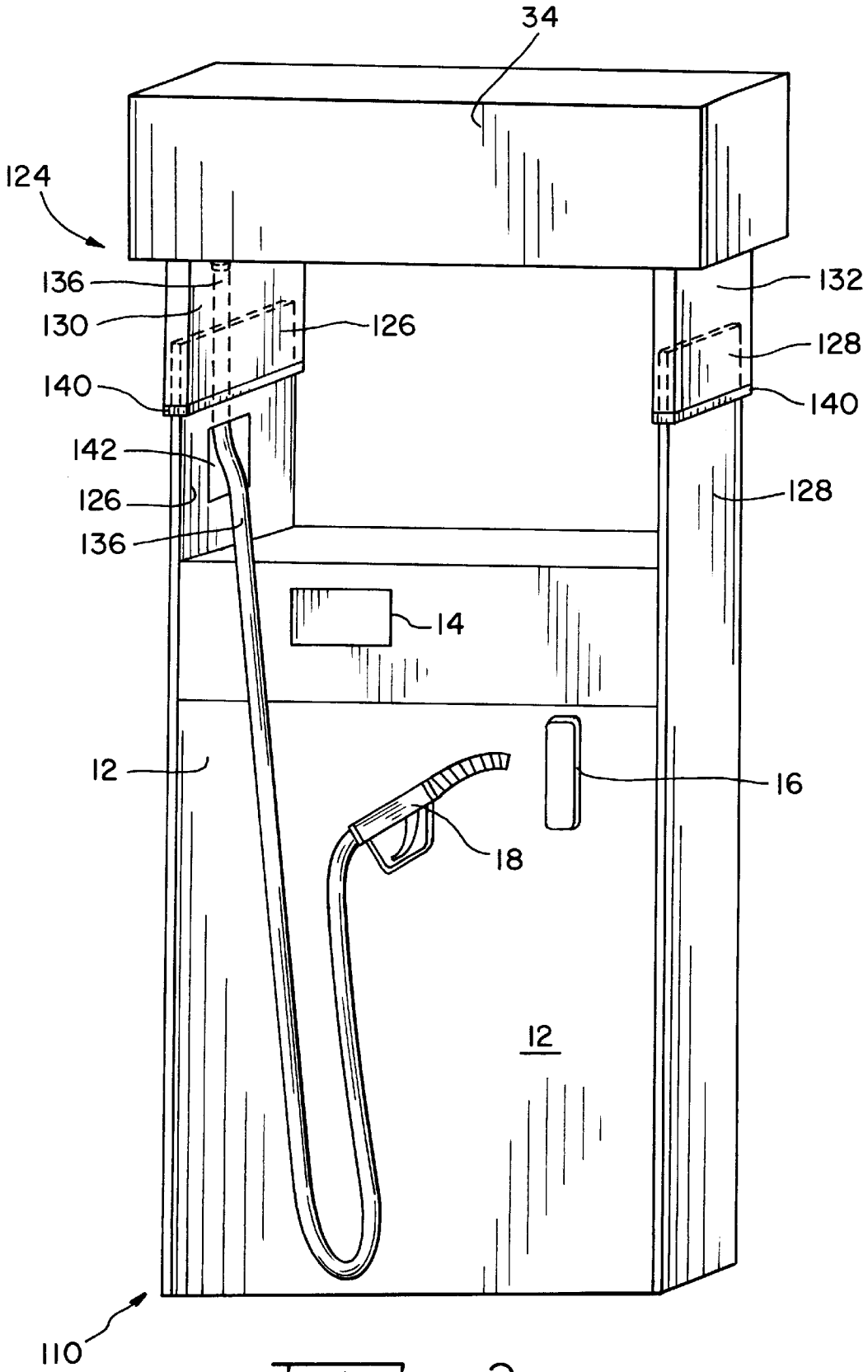
FIG. 2 is a front elevational view of a telescoping fuel dispenser according to the present invention.

Depicted in FIG. 2 is another embodiment of the present invention. Fuel dispenser 110 is depicting as having a specific means by which left and right upper column portions 130, 132 are engaged with left and right lower column portions, 126, 128, respectively, for movement of left and right upper column portions 130, 132 toward and away from base 12.

Left and right upper column portions 130, 132 have an interior dimension larger than that of left and right lower column portions 126, 128. As a result, left and right upper column portions 130, 132 telescopically engage with left and right lower column portions 126, 128.

During operation of the embodiment depicted in FIG. 2, left and right upper column portions 130, 132 are telescopically raise or lowered relative to left and right lower column portions 126, 128 and base 12.

Hose 136 is attached to the valance 34. Hose 136 extends from valance through left upper column portion 130 into the left lower column portion 126. Hose 136 exits left lower column portion 126 through hose passage 142.

Hose length control is achieved through use of the embodiment depicted in FIG. 2 by raising and lowering left and right upper column portions 130, 132, respectively. Raising of left and right upper column portions 130, 132 allows fuel dispenser 10 to accommodate longer length hoses 136. Left and right upper column portions 130, 132 can be raised to a level which limits the amount of contact hose 36 will have with the ground. The advantage of hose 136 having limited contact with the pavement is for safety concerns. For example, if the fuel hose were to lay on the pavement, a vehicle may inadvertently roll over and could possibly rupture the hose. Therefore, it is advantageous to prevent hose 136 from laying across the pavement.

FIGS. 1 and 2 depict frame 24, 124, respectively comprising left and right upper column portions affixed to valance 34. Alternatively, the frame consisted of a single column portion, for example, left upper column portion 30, 130.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuel dispenser with telescoping frame, comprising:

a base;

lower column portion; said lower column portion affixed to said base;

upper column portion; and said upper column portion operatively affixed to said lower column portion for movement of said upper column portion relative to said lower column portion.

2. The fuel dispenser according to claim 1 further comprising a hose attached to said lower column portion.

3. The fuel dispenser according to claim 1 further comprising a hose attached to said upper column portion.

4. The fuel dispenser according to claim 1 further comprising a second upper column portion and a valance spanning between said upper column portions.

5. The fuel dispenser according to claim 4 further comprising a hose attached to said valance.

6. The fuel dispenser according to claim 4 wherein said upper column portions are adapted for movement toward and away from said base.

7. The fuel dispenser according to claim 6 wherein said upper column portions are moveable toward and away from said base in unison.

8. The fuel dispenser according to claim 6 further comprising adjustment means for moving said upper column portion toward and away from said base.

9. The fuel dispenser according to claim 8 wherein said adjustment means is operable by a single person whereby said single person can move said upper column portion upward or downward relative to said base.

10. The fuel dispenser according to claim 1 wherein said upper column portion is adapted for movement toward and away from said base.

11. The fuel dispenser according to claim 10 further comprising adjustment means for moving said upper column portion toward and away from said base.

12. The fuel dispenser according to claim 11 wherein said adjustment means is operable by a single person whereby said single person can move said upper column portion upward or downward relative to said base.

13. The fuel dispenser according to claim 1 wherein said upper column portion operatively affixed to said lower column portion comprises said upper column portion telescopingly affixed to said lower column portion.

14. A fuel dispenser with telescoping frame, comprising:

a base;

a pair of lower column portions; said pair of lower column portions affixed to said base;

a pair of upper column portions;

a valance spanning between said pair of upper column portions;

said pair of upper column portions operatively affixed to said pair of lower column portions for movement of said upper column portions relative to said lower column portions, said pair of upper column portions are adapted for movement, toward and away from said base; and a hose attached to one of one said pair of upper column portions and said valance.

15. The fuel dispenser according to claim 14 wherein said upper column portion operatively affixed to said lower column portion comprises said upper column portion telescopingly affixed to said lower column portion.

16. The fuel dispenser according to claim 15 wherein said adjustment means is operable by a single person whereby said single person can move said upper column portion upward or downward relative to said base.

* * * * *